US005291178A

United States Patent [19]

Strief et al.

[11] Patent Number: 5,291,178

[45] Date of Patent: Mar. 1, 1994

[54] FILM-TYPE RESISTOR ASSEMBLY WITH FULL ENCAPSULATION EXCEPT AT THE BOTTOM SURFACE

[75] Inventors: Milton J. Strief, Fullerton; David L. Martin, La Habra, both of Calif.

[73] Assignee: Caddock Electronics, Inc., Riverside, Calif.

[21] Appl. No.: 852,580

[22] Filed: Mar. 17, 1992

Related U.S. Application Data

[63] Continuation-in-part of Ser. No. 683,302, Apr. 10, 1991, abandoned.

[51] Int. Cl.[5] ..... H01C 1/034

[52] U.S. Cl. ..... 338/226; 338/273; 338/275; 257/675; 257/796

[58] Field of Search ..... 257/787, 796, 675; 338/314, 260, 51, 220, 221, 226, 233, 273, 276, 275

[56] References Cited

U.S. PATENT DOCUMENTS

| | | | |
|---|---|---|---|
| 3,649,944 | 3/1972 | Caddock | 338/260 |
| 3,722,085 | 5/1973 | Caddock | 29/620 |
| 4,064,477 | 12/1977 | Thompson | 338/51 |
| 4,339,768 | 7/1982 | Keller et al. | 357/72 |
| 4,486,945 | 12/1984 | Aigoo | 357/72 |
| 4,507,675 | 3/1985 | Fujii et al. | 357/72 |
| 4,719,443 | 1/1988 | Salay | 338/314 |
| 4,868,637 | 9/1989 | Clements et al. | 357/72 |
| 4,950,427 | 8/1990 | Endo | 357/72 |
| 5,052,005 | 9/1991 | Tanaka et al. | 357/72 |

FOREIGN PATENT DOCUMENTS

| | | | |
|---|---|---|---|
| 0334473 | 2/1989 | European Pat. Off. | H01C 7/00 |
| 0418891 | 9/1990 | European Pat. Off. | H01L 23/31 |
| 61-150354 | 7/1986 | Japan | H01L 23/28 |
| 63-205935 | 8/1988 | Japan | H01L 23/28 |

OTHER PUBLICATIONS

P. 18 of Caddock Electronics, Inc. General Catalog 23rd Edition, 1989.

P. 17 of Caddock Electronics, Inc. General Catalog 23rd Edition, 1989.

Drawing dated Apr. 5, 1991, made by Caddock Electronics, Inc.

Motorola Catalog: 1989 Full Pak Power Semiconductors for Isolated Package Applications.

Pp. 6-18 and 1-134 of Motorola Catalog entitled Bipolar Power Transistor and Thyristor Data.

Data Sheet No. PD-2.068A from International Rectifier 1985 Product Guide and Specification Databook.

*Primary Examiner*—Rolf Hille

*Assistant Examiner*—David Ostrowski

*Attorney, Agent, or Firm*—Richard L. Gausewitz

[57] ABSTRACT

A film-type resistor having a high power rating and a relatively low manufacturing cost. The structural strength of the resistor is derived primarily from a molded body that covers both a film-coated substrate and a heatsink. The heatsink, to which the substrate is bonded in high thermal-conductivity relationship, has an exposed flat bottom surface of relatively large area.

32 Claims, 2 Drawing Sheets

FILM-TYPE RESISTOR ASSEMBLY WITH FULL ENCAPSULATION EXCEPT AT THE BOTTOM SURFACE

CROSS REFERENCE TO RELATED APPLICATION

This is a continuation-in-part of application Ser. No. 683,302, filed Apr. 10, 1991, now abandoned, for Film-Type Resistor Assembly with Full Encapsulation Except at the Bottom Surface.

BACKGROUND OF THE INVENTION

There has for several years been manufactured, by the assignee of applicants, a power resistor having a relatively thick copper base that serves not only as the heatsink but as the structural-support component of the resistor. A portion of this heatsink-base is apertured for mounting by a bolt to the underlying chassis. The remaining portion is indented in comparison to the first-mentioned portion, and has a ceramic substrate bonded thereto. A resistive film is provided on the side of the substrate remote from the heatsink. The film is connected to termination leads by metallization traces and solder. The substrate and the lead ends, and only part of the heatsink-base, are encapsulated in silicone molding compound, in such manner that the bottom surface of the heatsink-base——and the entire heatsink-base in the region of the bolt aperture——are exposed. The bottom heatsink surface is in flatwise contact with the chassis.

It has now been discovered that a power resistor having a vastly higher power rating than that of the resistor described above can be manufactured at less cost, and with strength adequate for the great majority of applications, although not as much strength as that of the above-indicated resistor incorporating relatively thick metal.

The power rating of the present resistor is at least double that of the earlier one referred to in the preceding paragraphs, yet the overall area of the present resistor (bottom surface) is less than 14% higher than that of the earlier one. The cost per watt of power rating of the present resistor is about one-half that of the earlier resistor referred to in the preceding paragraphs, in that there is less copper and less difficulty of assembly.

SUMMARY OF THE INVENTION

In the resistor of this invention, there is a relatively thin copper heatsink having little mechanical strength, and being capable of being readily directly engaged with the chassis for efficient transfer of heat to it. In the best mode, the heatsink is rectangular and not indented. Mounted on the majority of the area of the heatsink, on one side thereof, is a ceramic substrate. The underside of the substrate is bonded to the upper surface of the heatsink in efficient heat-transfer relationship. A resistive film is applied to the upper surface of the substrate.

The entire substrate and film, and all portions of the heatsink except its bottom surface, are molded into a synthetic resin body. At one region of the substrate, a region remote from leads the inner portions of which are also molded into the resin, there is a mounting hole provided through the synthetic resin and the heatsink.

As above indicated, the heatsink thickness is such that it is quite thin and not mechanically strong. The primary mechanical strength is provided by the synthetic resin, a portion of the resin supporting not only the heatsink but the ceramic substrate which is also quite thin.

There is no special or separate insulating layer between the resistive film and the heatsink; the substrate portion of the resistor is the electrical insulator between film and heatsink. The substrate is effectively bonded to the heatsink for thermal conductivity therebetween.

Although the heatsink and substrate are both quite thin, the strength they do have is employed effectively in maintaining the synthetic resin bonded therewith in effective encapsulating and strengthening relationship. Thus, in the best mode the heatsink and substrate have substantially the same width, and synthetic resin engages and bonds with the extreme edges thereof and of the bond region between them.

DESCRIPTION OF THE PREFERRED EMBODIMENT OF THE INVENTION

Figure 1:
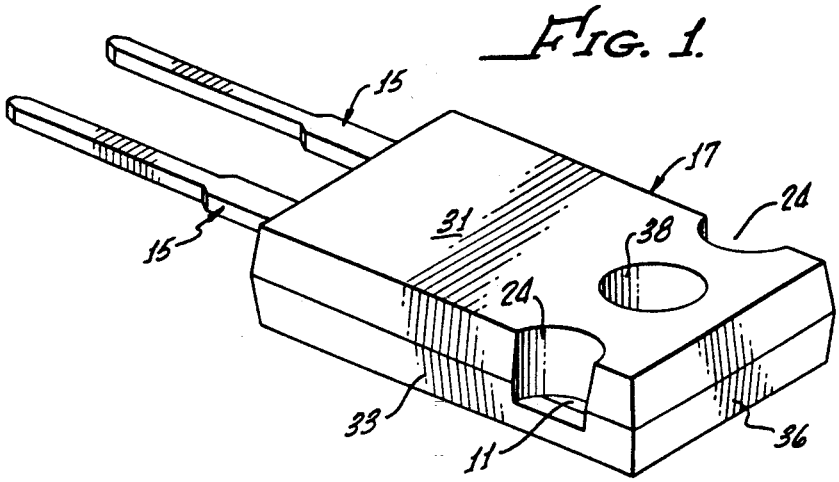
FIG. 1 is an isometric view of a resistor incorporating the present invention.

The resistor combination comprises a ceramic substrate 10 that is bonded to a metal heatsink 11. Metallization traces 12 and a resistive film 13 are provided on the side of substrate 10 remote from heatsink 11. A coating 14 is provided over the traces 12 and the film 13, namely on the great majority of the side of substrate 10 remote from the heatsink. Leads or pins 15 are soldered to traces 19. A body 17 of synthetic resin is molded around all parts of the above-specified elements excepting the outer portions of leads 15, and excepting the bottom surface of heatsink 11——which bottom surface is exposed so as to be engageable flatwise with an underlying chassis.

The various elements having been indicated in very general terms, there are now described relationships and factors which make the present resistor have a high power rating and relatively low manufacturing cost.

Substrate 10 is a flat ceramic rectangle or square, having parallel upper and lower surfaces, that is thin but is strong if not scribed. It is a good electrical insulator and is a relatively good thermal conductor. The preferred ceramic is aluminum oxide. Other less-preferred ceramics include beryllium oxide and aluminum nitride. The substrate 10 is sufficiently thick to be handled without substantial danger of breakage, and to augment the integrity and strength of the present combination as stated below. It is sufficiently thin to have good heat-transmission capability. The preferred thickness is about three-hundredths of an inch, for example 0.030 inch.

Figure 4:
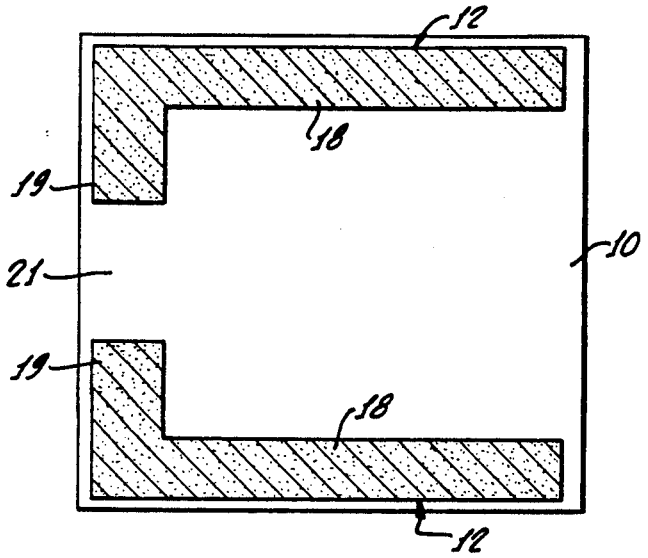
FIG. 4 is a plan view of the substrate having termination traces and pads thereon.

Referring to FIG. 4, there are screen-printed onto the upper side of substrate 10 the metallization traces 12, comprising two termination strips 18 that connect to pads 19. As shown, each strip-pad combination is generally L-shaped, with the pads extending towards each other and being separated from each other by a substantial gap 21. The outer edges of the strip-pad combinations are parallel to and spaced short distances inwardly from the extreme edges of the substrate 10, as shown.

Figure 5:
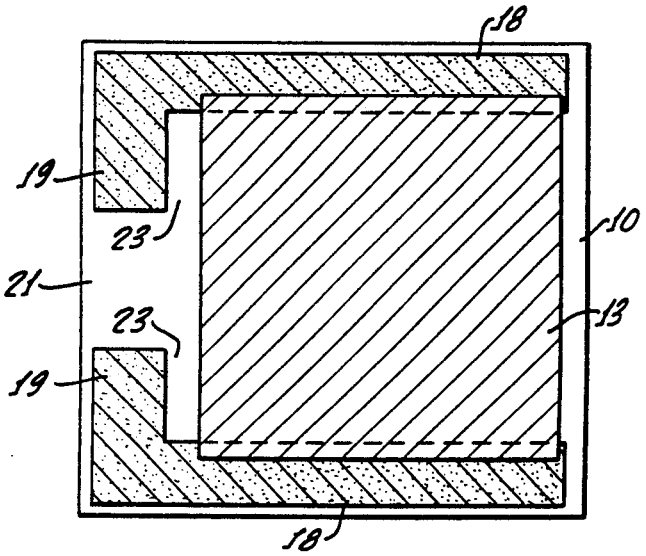
FIG. 5 is a view corresponding to FIG. 4 and also showing thee resistive film.

Referring next to FIG. 5, the resistive film 13 is screen-printed onto the same side of substrate 10, with the side edge portions of the film 13 overlapping and in contact with inner edge portions of termination strips 18. The deposited resistive film 13 is, in the example, substantially square. The edges of film 13 nearest pads 19 are spaced therefrom at gaps 23. The edge of film 13 remote from gaps 23 is spaced inwardly from the corresponding edge of substrate 10, the spacing being somewhat more than the spacing of the ends of termination strips 18 from such edge.

Figure 6:
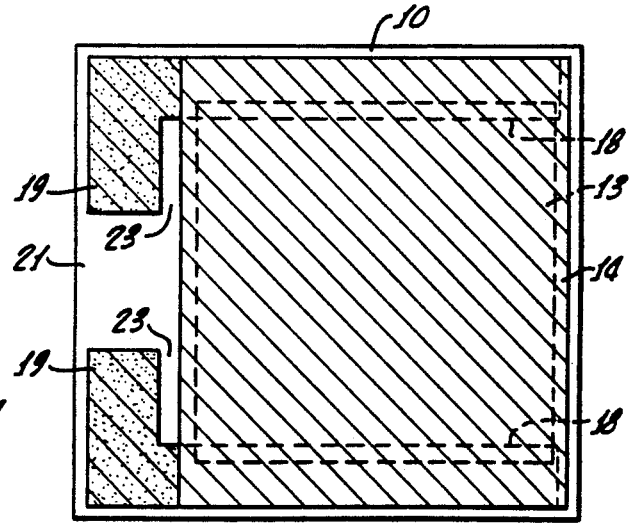
FIG. 6 is a view corresponding to FIGS. 4 and 5 and also showing the overglaze.

As shown in FIG. 6, the coating 14 is provided over resistive film 13, being preferably a layer of fused glass (overglaze). Along the edge of resistive film 13 adjacent gaps 23, the overglaze 14 extends beyond the resistive film, occupying an elongate area at the edges of gaps 21 and 23. The overglaze is also applied to the substrate along the edge remote from gaps 21 and 23, as shown at the right in FIG. 6.

The termination strip-pad combinations are, for example, a palladium-silver metallization deposited by screen-printing, as stated, and then fired. Thereafter, the resistive film 13 is applied by screen-printing, this film being preferably a thick film composed of complex metal oxides in a glass matrix. After deposition of the resistive film, it is fired at a temperature in excess of 800 degrees C. The overglaze 14 is a relatively low-melting-point glass frit that is screen-printed onto the described areas, following which it is fired at a temperature of about 500 degrees C. The distinct difference in firing temperatures between the film 13 and the overglaze 14 means that the overglaze will not adversely affect the film. The overglaze 14 prevents molded body 17 from adversely affecting the film 13.

Referring next to the heatsink 11, this is a sheet (with parallel upper and lower surfaces) of copper that is preferably nickel plated in order to prevent corrosion. Heatsink is rectangular and elongate, having——for reasons stated below——a width that is substantially the same as the width of substrate 10. The length of the heatsink is much greater than that of the substrate. Preferably, the substrate length is about two-thirds the heatsink length.

The thickness of heatsink 11 is sufficient that it conducts a substantial amount of heat longitudinally of the resistor. On the other hand, the heatsink is sufficiently thin that it conducts heat very readily from the ceramic to the chassis, and so that the heatsink does not have much structural strength. However, when the heatsink is combined with the ceramic substrate the combination does have significant strength in cooperation with the strength of body 17.

Heatsink 11 is sufficiently thick that, when it is held down in the mold for body 17, by pins (not shown) located at approximately the right third (FIGS. 1 and 3) of the heatsink, the entire bottom surface of the heatsink is in flatwise bearing engagement with the flat bottom mold surface. Such bottom heatsink surface lies in a single plane, and no synthetic resin passes beneath it.

Figure 3:
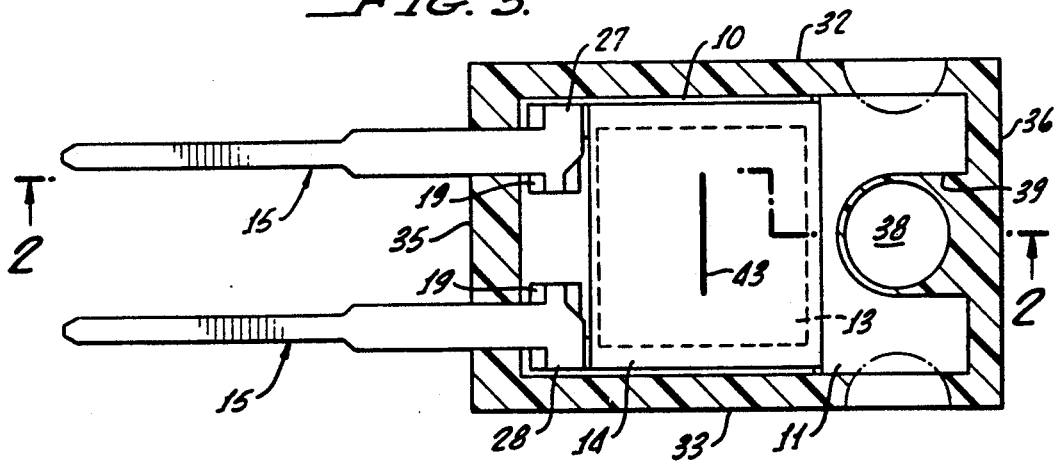
FIG. 3 is a horizontal sectional view of the resistor on line 3—3 of FIG. 2.

The mold pins make notches 24, shown in FIGS. 1 and 3, in which parts of the heatsink 11 are exposed (FIG. 1).

The preferred thickness of heatsink is about three-hundredths of an inch, preferably 0.032 inch. The length of the heatsink is about one-half inch, namely 0.540 inch. The width of the heatsink and of the substrate 10 is about one-third of an inch, namely 0.330 inch.

Figure 7:
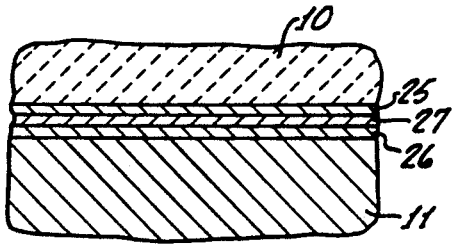
FIG. 7 is a greatly enlarged fragmentary horizontal sectional view, not to scale, showing bonding layers between the substrate and the heatsink.

The adjacent surfaces of substrate 10 and heatsink 11 are bonded together to maximize heat transfer therebetween, even when the resistor is used in a vacuum. The bonding also adds strength to the assembly. The preferred manner of effecting the bonding is to screenprint metallization (preferably palladium-silver) on the entire back or bottom surface of substrate 10, as shown at 25 in FIG. 7. The substrate is then fired. (The metallization layer on the back of the substrate is deposited and fired either before or after the termination strips 18 and pads 19 are deposited and fired. Firing is preferably separate relative to the metallizations on the front and back of the substrate. All metallizations are applied and fired before the resistive film and overglaze are applied and fired.)

As above noted, the heatsink 11 is nickel plated, and this is done on both the upper and lower sides. The nickel layer is shown at 26 in FIG. 7.

A layer of solder, 27, is then screen-printed onto the metallization 25 on the back of the substrate 10, at all regions. Then, the substrate 10 is located precisely on heatsink 11, so that the termination strips 18 are parallel to the side edges of the heatsink, as distinguished from the end edges thereof. One edge of heatsink 11 is caused to be in registry with that edge (shown at the left in FIG. 6) of the substrate 10 that is nearest the pads 19. Side edges of heatsink 11 and side edges of substrate 10 are caused to be registered, respectively. The substrate 10 is then clamped to the heatsink 11 and baked in order to melt the solder 27*a* and effect the bonding.

The solder 27 employed is preferably 96.5% tin and 3.5% silver.

Figure 2:
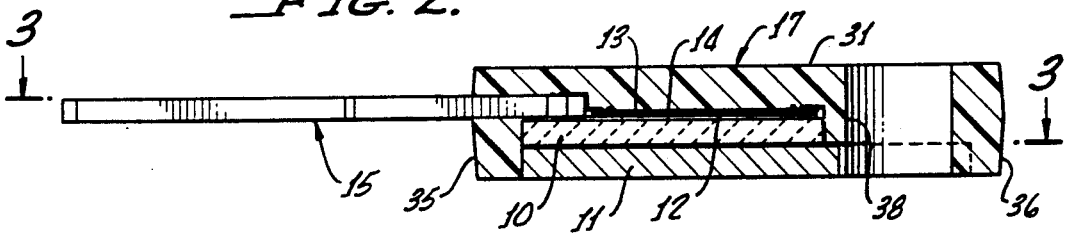
FIG. 2 is a vertical sectional view of the resistor of FIG. 1, taken on line 2—2 of FIG. 3, various deposited layers being shown but not to scale.

The leads or pins 15 are also secured to the substrate, at the upper side thereof as shown in FIGS. 2 and 3. The inner end of each lead 15 is numbered 28, being adapted to seat on a pad 19. Such inner ends 28 connect to relatively wide portions, which in turn connect at shoulders to narrow portions adapted to be inserted and soldered in holes in a circuit board.

The pads 19 are screen-printed with the above-specified solder, following which the inner ends 28 of leads 26 are located and clamped thereon. Then, the combination is baked in order to melt the solder and complete the soldering operation. The leads may be connected to pads 19 at the same time that the heatsink is bonded to the substrate, or these operations may be separate.

After substrate 10, heatsink 11 and associated layers and leads are manufactured and connected as described, the body 17 of synthetic resin is molded around all sides thereof except the bottom surface of heatsink 11. As shown in FIG. 2, the top surface 31 of the molded body 17 is parallel to the bottom surface of heatsink 11. As shown in FIGS. 1-3, the molded body has generally vertical side surfaces 32,33 and end surfaces 35,36. However, the side and end surfaces 35 and 36 are bevelled, for example as shown in FIG. 2. The bottom of the body 17 is planar, and flush with the bottom of the heatsink.

Side surfaces 32,33 are respectively spaced substantial distances outwardly from the edges of the substrate and heatsink; and end surfaces 35,36 are respectively spaced substantial distances outwardly from the end of the heatsink (at the outer end of the resistor) and heatsink-substrate combination (at the inner end thereof).

Molded body 17 is rectangular and elongate, and has its axis parallel to that of the substrate-heatsink combination. In the present example, the length of the body is about two-thirds inch, namely 0.640 inch, and the width thereof is about four-tenths inch, namely 0.410 inch. The thickness of the body, from the bottom of the heatsink to the top surface 31, is about one-eighth inch, namely 0.125 inch.

Body 17 is formed of a rigid epoxy. The body is formed of high thermal-conductivity rigid epoxy in some of the resistors, but not in many other of the resistors. Whether or not high thermal-conductivity resin is used depends upon the particular application. The vast majority of the heat passes downwardly from resistive film 13 through substrate 10 and heatsink 11 into the chassis. Much of the heat flows to the right as viewed in FIGS. 2 and 3, into the heatsink region that is not beneath the substrate.

A substantially cylindrical hole 38 is provided in and substantially centered in that portion of synthetic resin body 17 that does not overlie the substrate. Such hole has a diameter (for example, 0.125 inch) that is smaller than the diameter of a recess 39 centered in that edge of heatsink 11 remote from the leads. The recess 39 has a generally U-shaped side surface (FIG. 3), the rounded "bottom" of which is coaxial with hole 38.

It is pointed out that the heatsink has a relatively large area, and (FIG. 3) is not indented at the region where the substrate 10 is located; this is one of the factors causing a high power rating to occur.

The molded body 17, substrate 10 and heatsink 11 combine to cause the combination to have substantial strength without employing a thick and expensive metal heatsink. One reason there is no need for an indented or thick heatsink, or an undercut heatsink, is the above-described substantially flush relationship between the outer edges of substrate 10 and heatsink 11. These edges, and the small space or rough region at the outer edges of the bond between the substrate and heatsink, create somewhat rough gripping areas for the synthetic resin forming body 17, so that the heatsink and substrate do not tend to separate from the synthetic resin.

In a less-preferred embodiment, the substrate is somewhat wider than the heatsink, so that the side edges of the heatsink (those edges extending parallel to the leads or pins) are undercut relative to the substrate edges.

The present resistor is mounted on a chassis by providing a washer above hole 38, inserting a bolt through it and clamping down. The bolt creates the greatest pressure at the region outwardly (to the right) from substrate 10 and the resistive film thereon, but there is also adequate pressure at the underside of the heatsink, directly below the substrate, to cause effective conduction of heat into the chassis at that region. A small amount of thermal grease is preferably employed between the heatsink and chassis.

It is pointed out that the precise resistance value of resistive film 13 is trimmed in a suitable manner. Preferably, a slot 43 is laser-cut through film 13 perpendicularly to traces 18, which traces are parallel to each other. The width of such slot is increased until the exact desired resistance value is obtained. Slot 43 is parallel to the direction of current flow between traces 18 through the resistive film, and this is highly beneficial vis-a-vis achieving uniformly high current density, and high power-handling capability.

The foregoing detailed description is to be clearly understood as given by way of illustration and example only, the spirit and scope of this invention being limited solely by the appended claims.

What is claimed is:

1. A film-type power resistor combination, which comprises:

(a) an elongate flat metal heatsink having substantially parallel upper and lower surfaces, (b) a flat ceramic substrate having substantially parallel upper and lower surfaces, said substrate having a size and shape so related to those of said heatsink that when said substrate is in a predetermined position with its lower surface parallel to and adjacent both one end portion and an intermediate portion of said upper heatsink surface, and with said lower substrate surface overlapping said upper heatsink surface, the following relationship exist:

(1) the outer end portion of said upper heatsink surface is outwardly spaced from said lower substrate surface, and (2) a substantial portion of said upper heatsink surface, and which is adjacent said other end portion of said upper heatsink surface, extends outwardly from beneath said lower substrate surface, (c) means to effect a high thermal-conductivity bond between said lower substrate surface and said upper heatsink surface when said substrate is in said predetermined position, to thereby hold said substrate in said predetermined position and in high thermal-conductivity relationship to said heatsink, (d) an electrically resistive film provided on said upper surface of said substrate, (e) termination pins or leads connected physically and electrically to spaced-apart portions of said film and extending away from said substrate for connection into an electric circuit, and (f) a molded body of synthetic resin encapsulating said substrate, the inner portions of said pins, and at least substantially the entire upper surface of said heatsink, said lower heatsink surface being exposed so as to be mountable in flatwise engagement with the upper surface of a chassis, said molded body being thick to thereby provided structural strength to the combination, as well as environmental protection for said resistive film, said heatsink being a separate metal element that is not integral with any of said termination pins.

2. The invention as claimed in claim 1, in which said heatsink is not adapted to be connected to any source of electrical power.

3. The invention as claimed in claim 1, in which said heatsink is rectangular and does not have major indentations therein.

4. The invention as claimed in claim 1, in which said heatsink, at the portions thereof that do not underlie said lower substrate surface, has a hole therethrough for reception of a mounting bolt, and in which said body of synthetic resin has a hole therethrough registered with said first-mentioned hole for reception of said bolt.

5. The invention as claimed in claim 1, in which said heatsink is sufficiently thin that it does not have major structural strength except in combination with said body of synthetic resin, and is sufficiently thick that it will conduct significant heat therealong from portions of said heatsink underlying said lower substrate surface to the portions thereof not underlying said lower substrate surface.

6. The invention as claimed in claim 1, in which said heatsink has a thickness of about three-hundredths of an inch.

7. The invention as claimed in claim 6, in which said substrate has a thickness of about three-hundredths of an inch.

8. The invention as claimed in claim 1, in which said molded body has side and end portions, of substantial width and thickness, encompassing substantially all of said heatsink.

9. The invention as claimed in claim 1, in which said substrate has outer edge portions so related to those edge regions of said heatsink underlying said substrate that said substrate, in cooperation with said heatsink and the bond between said substrate and heatsink, aids in maintaining said molded body in assembled relationship with said substrate and heatsink.

10. The invention as claimed in claim 9, in which the extreme outer edge surfaces of said substrate, at least a substantial intermediate portion of said heatsink, are substantially flush with the extreme outer edge surfaces of said heatsink at such portion, said extreme outer edge surfaces of said substrate and of said heatsink cooperating with the regions of said molded body at said edge surfaces in aiding in maintaining said molded body assembled with said heatsink and substrate.

11. A film-type power resistor combination, which comprises:

(a) an elongate flat metal heatsink the surface area of which may be considered as divided into a first one-third at one end portion thereof, a second one-third at the other end portion thereof, and a third one-third therebetween, said heatsink being thin but having sufficient thickness that when downward pressure is applied to said first one-third of said surface area in a mold, said second and third one-thirds of said area will bear down on a flat bottom wall of the mold cavity in flatwise engagement therewith, (b) a flat ceramic substrate mounted over and adjacent the majority of the top surface of said heatsink, generally above at least said second and third one-thirds of said area, (c) means to effect a high heat-transmission bond between the bottom surface of said substrate and said top surface of said heatsink, (d) first and second trace and pad means provided on the top surface of said substrate in spaced relationship from each other, (e) an electrically resistive film provided on said top surface of said substrate and extending between said first and second trace and pad means, (f) termination plus connected respectively to said first and second trace and pad means and extending outwardly from said substrate, and (g) a rigid synthetic resin body molded around substantially all portions of said above-recited elements excepting said bottom surface of said heatsink and the outer portions of said termination pins, said synthetic resin body having substantial thickness sufficient that, in combination with said heatsink and substrate and bond means, it makes said resistor rigid, said heatsink being a separate metal element that is not integral with any of said termination pins.

12. The invention as claimed in claim 11, in which a trimming slot is provided through said resistive film, in which said first and second trace and pad means are substantially parallel to each other, and in which said trimming slot is substantially perpendicular to said trace and pad means whereby said trimming slot is substantially parallel to the direction of current flow through said resistive film between said trace and pad means.

13. The invention as claimed in claim 11, in which said heatsink is not adapted to be connected to any source of electrical power.

14. The invention as claimed in claim 11, in which a coating of barrier material is provided over said resistive film, between said resistive film and said synthetic resin body.

15. The invention as claimed in claim 11, in which no insulator is provided between the bottom surface of said substrate and the top surface of said heatsink.

16. The invention as claimed in claim 11, in which said heatsink is rectangular, elongate, and substantially unindented, and in which said substrate is bonded to the central portion and one end portion of said heatsink.

17. The invention as claimed in claim 16, in which said other end portion of said heatsink has a bolt hole therethrough, and in which said synthetic resin body has a bolt hole therethrough registered with said first-mentioned bolt hole.

18. The invention as claimed in claim 17, in which said substrate is square or rectangular, and is bonded on said heatsink in such relationship that three of its edges are adjacent and parallel to three edges of said heatsink.

19. The invention as claimed in claim 11, in which said substrate covers about two-thirds of said heatsink.

20. The invention as claimed in claim 11, in which said substrate is about one-third inch long and about one-third inch wide and about three-hundredths inch thick.

21. The invention as claimed in claim 11, in which said heatsink is about three-hundredths inch thick.

22. The invention as claimed in claim 20, in which said molded body is about two-thirds inch long, about four-tenths inch wide and about one-eight inch thick.

23. The invention as claimed in claim 20, in which said molded body is epoxy, said heatsink is copper, and said substrate is aluminum oxide.

24. A film-type power resistor combination, which comprises:

(a) a flat metal heatsink, (b) a flat ceramic substrate mounted over and substantially parallel to at least the majority of the top surface of said heatsink, (c) first and second trace and pad means provided on said substrate, said first and second trace and pad means being spaced apart from each other, (d) an electrically resistive film provided on said substrate and extending between said first and second trace and pad means, (e) means to effect a high heat-transmission relationship between said resistive film and said heatsink, (f) termination pins bonded respectively to said trace and pad means and extending outwardly from said substrate, and (g) a synthetic resin body molded around substantially all portions of said above-recited elements excepting the bottom surface of said heatsink and the outer portions of said termination pins, said synthetic resin body having substantial thickness sufficient that, in combination with said heatsink and substrate, it makes said resistor strong, said synthetic resin body having a bolt hole therethrough for use in connection of said resistor to a chassis, said heatsink being a separate metal element that is not integral with any of said termination pins.

25. The invention as in claim 24, in which said synthetic resin body has in upper surface parallel to said heatsink, said upper surface being disposed in a plane that is farther from said heatsink than is said resistive film.

26. The invention as claimed in claim 24, in which said heatsink is not adapted to be connected to any source of electrical power.

27. The invention as claimed in claim 1, in which said means to effect a high heat-transmission relationship between said lower substrate surface and said upper heatsink surface comprises solder.

28. The invention as claimed in claim 27, in which said solder is a palladium-silver alloy.

29. The invention as claimed in claim 24, in which a trimming slot is provided through said resistive film, in which said first and second trace and pad means are substantially parallel to each other, and in which said trimming slot is substantially perpendicular to said trace and pad means whereby said trimming slot is substantially parallel to the direction of current flow through said resistive film between said trace and pad means.

30. The invention as claimed in claim 29, in which a barrier coating is provided over said resistive film, between it and said synthetic resin body, to prevent said synthetic resin body from adversely affecting said resistive film.

31. The invention as claimed in claim 30, in which said synthetic resin body is high thermal-conductivity synthetic resin.

32. The invention as claimed in claim 30, in which said barrier coating is glass having a firing temperature much lower than that of said resistive film.

* * * * *

UNITED STATES PATENT AND TRADEMARK OFFICE

CERTIFICATE OF CORRECTION

PATENT NO. : 5,291,178

DATED : March 1, 1994

INVENTOR(S) : Strief et al.

It is certified that error appears in the above-indentified patent and that said Letters Patent is hereby corrected as shown below:

Claim 1 (column 6, line 19), delete "outer" and substitute therefor ---other---.

Claim 11 (column 7, line 56), delete "plus" and substitute ---pins---.

Signed and Sealed this

Eighteenth Day of October, 1994

*Attest:*

*Attesting Officer*

BRUCE LEHMAN

*Commissioner of Patents and Trademarks*